United States Patent [19]

Walkup

[11] 4,344,664

[45] Aug. 17, 1982

[54] WIDE COMPLIANCE INSULATION DISPLACEMENT TERMINAL BLOCK

[75] Inventor: William B. Walkup, Southboro, Mass.

[73] Assignee: Ark-Les Corporation, Watertown, Mass.

[21] Appl. No.: 193,652

[22] Filed: Oct. 3, 1980

[51] Int. Cl.[3] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,845,455 | 10/1974 | Shoemaker | 339/97 R |
| 4,043,628 | 8/1977 | Narozny | 339/99 R |
| 4,160,574 | 7/1979 | De Ross | 339/99 R |

FOREIGN PATENT DOCUMENTS

| | | | |
|---|---|---|---|
| 1196270 | 6/1970 | United Kingdom | 339/99 R |

*Primary Examiner*—Joseph H. McGlynn

[57] ABSTRACT

A terminal and terminal block for connecting an insulated wire to electrical circuitry, without stripping and preparing the wire. The terminal has a pair of opposing spring arms, whose parallel edges define a wire-receiving slit. The terminal block has a base, in which the terminal is provided, and a top. In a first terminal block position, base and top allow a wire to be inserted into the block and laid over the terminal. The top is movable toward the base to reach a second terminal block position in which base and top are locked together. The motion of the top relative to the base forces the wire into the terminal slit; the edges slice the insulation to make electrical contact with the wire. The terminal remains compliant over a wide range of wire sizes. A clinch spring is provided in the terminal block top and provides additional retention of the wire in the block and resistance to pulling or twisting.

10 Claims, 12 Drawing Figures

FIG 7
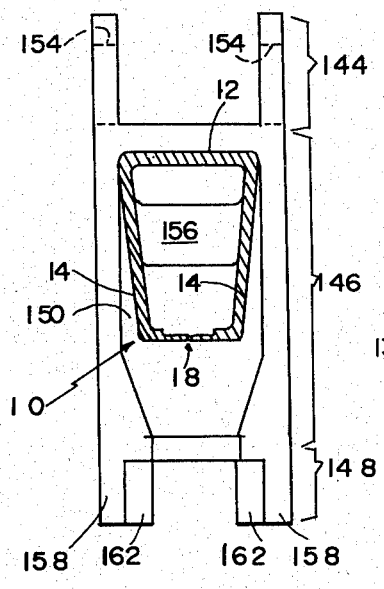
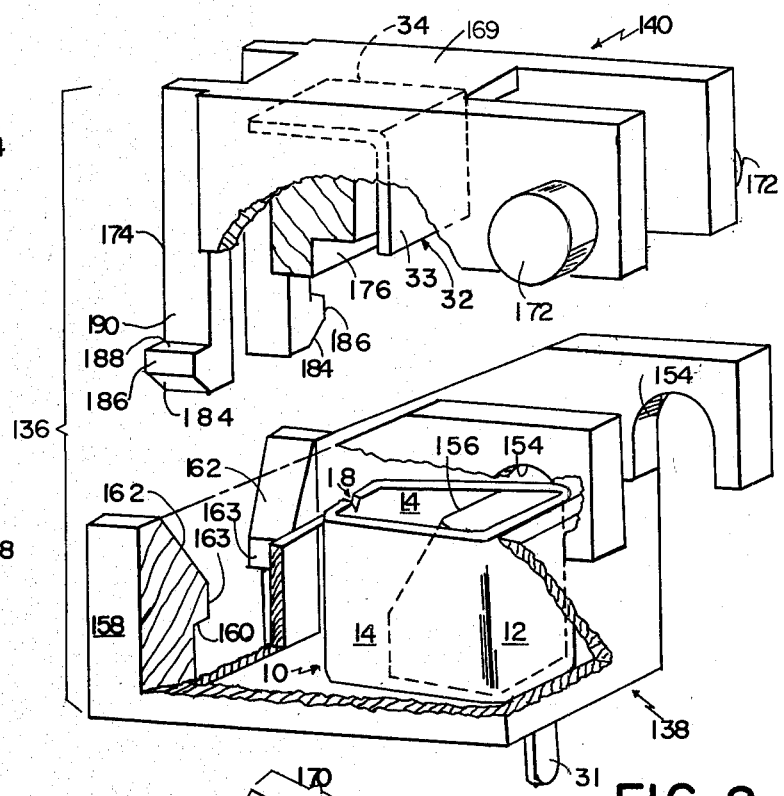
FIG 8
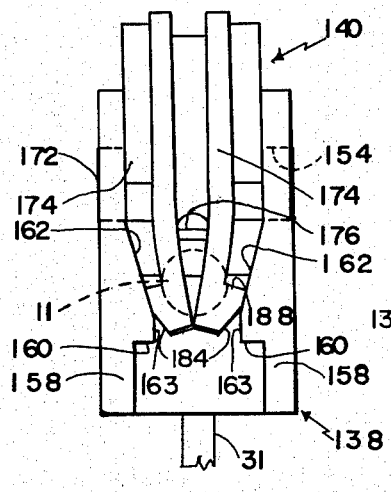
FIG 10
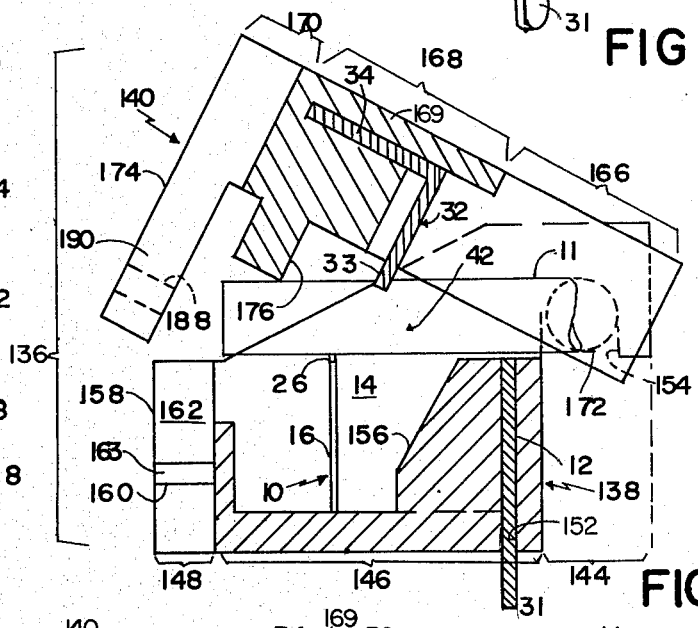
FIG 9
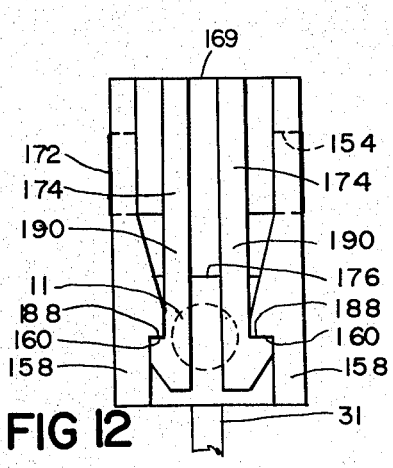
FIG 12
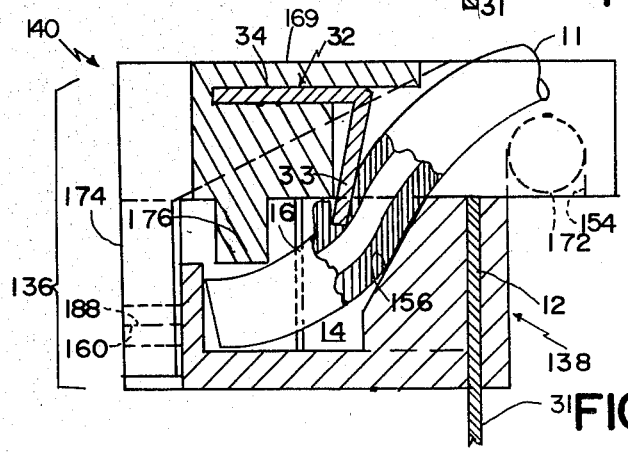
FIG 11

WIDE COMPLIANCE INSULATION DISPLACEMENT TERMINAL BLOCK

This invention relates to terminals for connecting insulation-clad wires to electrical circuitry.

In particular, it relates to a terminal adapted to retain an insulated wire, of any of a range of sizes, and a terminal block providing such a terminal and adapted to be connected to electrical circuitry such as, for example a printed circuit board.

In modern technology, printed circuit boards form a part of a very large number of different structures, particularly structures whose control sections include microprocessors or other forms of digital logic. In such structures, it is generally necessary to electrically connect other devices to the printed circuit board. Such devices may include, for example, measuring or monitoring devices, whose signals must be input to the control section, and switches, valves or motors, to be operated by signals output from the control section. Such electrical connections, which may be very numerous in a single structure, are made by means of insulated wires, and the problem therefore arises of making a satisfactory connection of such an insulated wire to the appropriate point on a printed circuit board.

A "satisfactory connection" is one that remains good through such tests as rotation, over a period of hours, of the retained wire, with a weight on the end of the wire, or a pull on the end of the wire of a force proportional to the gauge of the wire, up to 60 to 70% of the strength of the wire. Such tests are set as standards, for example, by the Underwriters' Laboratory, which requires the connection to withstand a pull of 30 lb for 16 gauge wire, and of 60 lb for 14 gauge wire.

Connections of insulated wires to printed circuit boards have been made by means of hand preparation and assembly, including stripping the wire to be connected, soldering the stripped end to a terminal, and attaching the terminal or a terminal assembly to the printed circuit board by a screw or similar means. Such hand preparation and assembly is necessarily both time consuming and expensive and increases the costs of the structures including such connections.

In other applications, such as, for example, field wiring applications, it is desirable to provide a satisfactory connection of an insulated wire to electrical circuitry at locations where there is no ready access to equipment for automatic terminalling or wire preparation.

It is therefore an object of the present invention to provide means for making electrical connections of insulated wires to printed circuit boards (or other flat substrates) which are resistant to pulling and twisting of the wire, which satisfactorily meet standard tests, and which may be made quickly and economically.

It is another object of the invention to provide such means for making electrical connections that does not require hand preparation of the wire to be connected, such as stripping of the insulating material from the conductor.

It is another object of the invention to provide means for making electrical connections of insulated wires to electrical circuitry in field applications, where there may be no ready access to automatic terminalling or wire preparation equipment.

It is still another object to provide such means for making connections that is small and compact, and fits acceptably in the limited space adjacent a printed circuit board in an assembly of such boards.

It is a further object of the invention to provide means for making electrical connections of insulated wires to printed circuit boards which will accept a wide range of wire sizes, preferably from 14 to 20 gauge.

According to the invention, a one-piece, insulation-displacing contact spring terminal is provided that is adapted to pierce the surrounding insulation of a wire comprising an insulation-clad conductor, the conductor having a predetermined diameter and having a central axis, by relative movement of the wire in a direction generally perpendicular to its axis to establish positively-gripping electrical contact with the conductor.

The terminal is of resilient, electrically conductive sheet metal of at least five times greater width than thickness, and has a generally flat trunk and a pair of opposing spring arms integrally connected to the trunk at opposite sides thereof. The spring arms have opposed, widthwise-extending, insulation-slicing, generally parallel, wire-contacting edges of reduced thickness remote from said trunk; the edges lie generally in a single plane and are spaced from one another to define a wire-receiving slit therebetween narrower than the diameter of the conductor.

The portion of a spring arm extending between the trunk and the edges has a rounded trunk corner adjacent the trunk and a rounded edge corner adjacent the edge, with a longitudinally-extended, generally straight connecting portion therebetween. The connecting portion forms an included angle with the trunk of less than about ninety degrees, and forms an included angle with the plane of the opposed edges of greater than about ninety degrees. The wire-contacting edges have at at least one end thereof opposed beveled corners for receiving, engaging and slicing the surrounding insulation of the wire by movement of the wire between the corners and into the slit between the opposed edges, in a direction generally perpendicular to the axis of the wire and to the plane, and through the slit to establish positively-gripping electrical contact between the contact spring terminal and the wire conductor.

Further according to the invention, a terminal block is provided for connecting a wire comprising a conductor surrounded by insulating material to a thin flat substrate such as a printed circuit board, defined as horizontal. The block comprises a base and a top, the base having a flat bottom adapted to overlie a board or other flat substrate. The base and top provide cooperating locking means adapted to lock base and top together in one of a first, wire-admitting terminal block position and a second, wire-retaining terminal block position. The base and top are relatively movable, by external force applied to the top, from the first to the second terminal block position.

The base provides a conductive contact spring terminal having opposed wire-contacting edges defining a wire-receiving slit at the rear of the terminal; the terminal provides an electrical contact extending through the base flat bottom. The base and top provide structure together defining in either position a wire aperture at the front of the terminal block, adapted to admit a wire generally horizontally (in the plane of the flat substrate). The top provides a strain relief clinch spring having a downwardly extending wire-engaging tongue forward of the terminal wire-receiving slit in the second, wire-retaining terminal block position.

The base has wire-positioning structure adjacent the terminal slit and forward thereof, while the top has wire-positioning structure adjacent the clinch spring tongue and rearward thereof. The base and top wire-positioning structure cooperate, during motion of the top from the first, wire-admitting terminal block position to the second, wire-retaining terminal block position, to force a wire downwardly into the slit, the slit edges being normal to the wire and extending through the insulating material into electrical contact with the conductor, and to force the clinch spring tongue into the insulating material into retaining relationship with the wire. The base contact spring terminal and the top clinch spring cooperate, in the second, wire-retaining position of the terminal block, to retain the wire against pulling and twisting of its free end.

In preferred embodiments, the terminal is of the type previously described. The strain relief clinch spring is of a resilient sheet metal, and comprises a retaining tab and a wire-engaging tongue including an angle of about ninety degrees between them. The wire-engaging tongue is forward of the contact spring terminal wire-receiving slit in the second, wire-retaining position of the terminal block.

In a first preferred embodiment of the terminal block, the terminal connector block comprises a base and a top adapted to engage with one another in either of a first, wire-admitting position and a second, wire-retaining position, and relatively movable from the first to the second position. The base provides a generally flat lower surface adapted to overlie a generally flat substrate, and comprises generally a forward section, a middle section, and a back section. The base forward and middle sections together provide a recess opening away from the base lower surface, the base forward section providing a passage communicating between the base recess and the base lower surface. The base recess and passage are adapted to receive the terminal with the electrical contact extending through the base passage and with the terminal trunk lying above the electrical contact, the terminal wire-receiving slit lying adjacent the base back section. The base further provides wire-positioning structure within the base recess and surrounded by the terminal, having a wire-positioning surface sloping upwardly from adjacent the terminal wire-receiving slit to adjacent the trunk and having a maximum height above the base recess of greater than that of the terminal.

The base middle section provides a pair of opposed top-retaining arms each extending upwardly with respect to the base lower surface, each top-retaining arm providing top-engaging structure at its end remote from the base flat lower surface. Each top-retaining arm is resiliently connected to the base middle section, the top-retaining arms being biased inwardly toward one another.

The top-engaging structure comprises a top-engaging surface lying generally parallel with the base lower surface and disposed on the inward side of the top-retaining arm; a first camming surface sloping upwardly and outwardly from adjacent the inner edge of the top-engaging surface; and a generally vertical tip surface between the top-engaging surface and the first camming surface.

The top provides a top recess adapted to receive the clinch spring retaining tab in such a way that the clinch spring wire-engaging tongue extends downwardly toward the base wire-positioning surface.

The top comprises generally a forward section, a middle section, and a back section. The top back section provides a slide element engageable with the base back section to define a direction of relative motion between the top and base generally parallel with the terminal wire-receiving slit. The top front section provides an aperture adapted to cooperate with the base wire-positioning structure and the base forward section in either of the first and said second positions to define a terminal block wire-admitting aperture.

The top middle section provides a wire-positioning surface below the top recess and rearward of the clinch spring wire-engaging tongue, sloping generally parallel with the base wire-positioning surface. The top middle section further provides base-engaging structure adapted to engage with the base arm top-engaging structures. The base-engaging structure comprises, on either side of the top: a generally vertical inner surface; a camming surface sloping upwardly and outwardly from the inner surface; and a generally vertical outer surface; a bearing surface connects the outer surfaces. The base top-retaining arms and the top base-engaging structure together define cooperating locking means locking the base and top together in either of the first, wire-admitting position and the second, wire-retaining position. The top and base in the first, wire-admitting terminal block position cooperate to permit a wire to be placed overlying the terminal wire-receiving slit and the base wire positioning surface, and extending through the wire-admitting aperture.

The top is movable relative to the base by the application of external force to the top bearing surface to move the terminal block from its first, wire-admitting position to its second, wire-retaining position. The base arm first camming surfaces move on the top middle section second camming surfaces to cam the base arms outwardly against the bias and thereby to disengage the base arm top-engaging structures from the top lower base-engaging surfaces; the top-engaging arms thereafter move inwardly to bring the base arm top-engaging structures into engagement with the top upper base-engaging surfaces to retain the terminal block in its second position.

The base and top wire-positioning surfaces cooperate during the relative motion to force the wire into the terminal wire-receiving slit from above, to force the wire-contacting edges through the insulating material and into engagement with the wire, and to force the clinch spring wire-engaging tongue through the insulation forwardly of the terminal wire-receiving slit.

In a second preferred embodiment of the terminal block, the base middle section provides a recess opening away from the base bottom surface, and a passage communicating between the recess and the base bottom surface, the base recess and passage being adapted to receive the terminal with its terminal electrical contact extending through the base passage, the terminal wire-receiving slit lying adjacent the base back section. The base further provides wire-positioning structure within the recess and surrounded by the terminal, the wire-positioning structure having a wire-positioning surface sloping upwardly and away from adjacent the bottom of the terminal wire-receiving slit.

The base forward section provides two curved pivot bearing surfaces; the base back section provides a pair of opposed top-retaining arms each extending upwardly with respect to the base bottom surface. Each top-retaining arm provides a top-engaging structure at its end remote from the base bottom surface. Each top-engaging structure comprises a top-engaging surface lying generally parallel with the base bottom surface and disposed on the inward side of the top-retaining arm; a first camming surface sloping upwardly and outwardly from adjacent the inner end of the top-engaging surface; and a generally vertical tip surface between the top-engaging surface and the first camming surface.

The top comprises generally a forward section, a middle section, and a back section. The top forward section provides two pivot ears each journaled in a base pivot bearing surface to define an arcuate direction of relative motion of the top with respect to the base, the top back section moving in a direction generally parallel with the wire-receiving slit during the relative motion.

The top middle section provides a top recess adapted to receive the clinch spring in such a way that the clinch spring wire-engaging tongue extends downwardly toward the base wire-positioning surface. The top further provides interior wire-positioning structure below and rearward of the clinch spring wire-engaging tongue, extending generally toward the bottom of the base.

The top back section provides two legs, each leg being resiliently connected to the top back section and biased outwardly of the top. Each leg provides a base-engaging structure comprising a second camming surface sloping upwardly and outwardly from the bottom of said leg; a generally vertical outer surface adjacent and above the second camming surface; a base-engaging surface generally parallel with the base bottom surface in the second, wire-retaining terminal block position; and a generally vertical inner surface. The base top-retaining arms and top legs define cooperative locking means locking the base and top together in either of the first, wire-admitting position and the second, wire-retaining position.

The top and base, in the first, wire-admitting terminal block position cooperate to permit a wire to be placed overlying the terminal wire-receiving slit and the base wire-positioning surface and extending between the base forward section and the top forward section. The top legs are disengaged from the base arms in the terminal block first, wire-admitting position, said top being movable with respect to the base by the application of external force to the top surface of the top middle section to cause the top to pivot about the pivot ears journaled in the bearing surfaces, to move the terminal block from its first, wire-admitting position to its second, wire-retaining position. During such motion, the top leg second camming surfaces move on the base arm first camming surfaces to cause the top legs to be compressed inwardly toward one another against their outward bias, the top legs being thereafter freed to move outwardly to bring their base-engaging surfaces into engagement with the base arm top-engaging surfaces to retain the terminal block in its second, wire-retaining position.

The base and top wire-positioning structure cooperate during the motion of the terminal block from its first to its second position to force a wire into the terminal wire-receiving slit from above, to force the wire-contacting edges through the wire insulating material and into engagement with the conductor, and to force the clinch spring wire-engaging tongue into the insulating material forwardly of the terminal wire-engaging slit.

Other objects, features and advantages will appear from the following detailed description of two preferred embodiments of the invention, together with the drawing, in which:

FIG. 7 is a plan view of the base of the terminal block according to a second embodiment of the invention, including the contact spring terminal;

FIG. 8 is an exploded view of the terminal block of FIG. 7, including the terminal terminal and clinch spring;

FIG. 9 is a sectional view of the assembled terminal block according to the second embodiment, in its wire-receiving position;

FIG. 10 shows a portion of the terminal block according to the second embodiment, in motion between its first and second positions;

FIG. 11 is a sectional view similar to that of FIG. 9 but showing the terminal block in its wire-retaining position;

FIG. 12 shows a portion of the terminal block of FIG. 11; and

FIG. 13 is a detail of a portion of the contact spring terminal of the invention.

Figure 2:
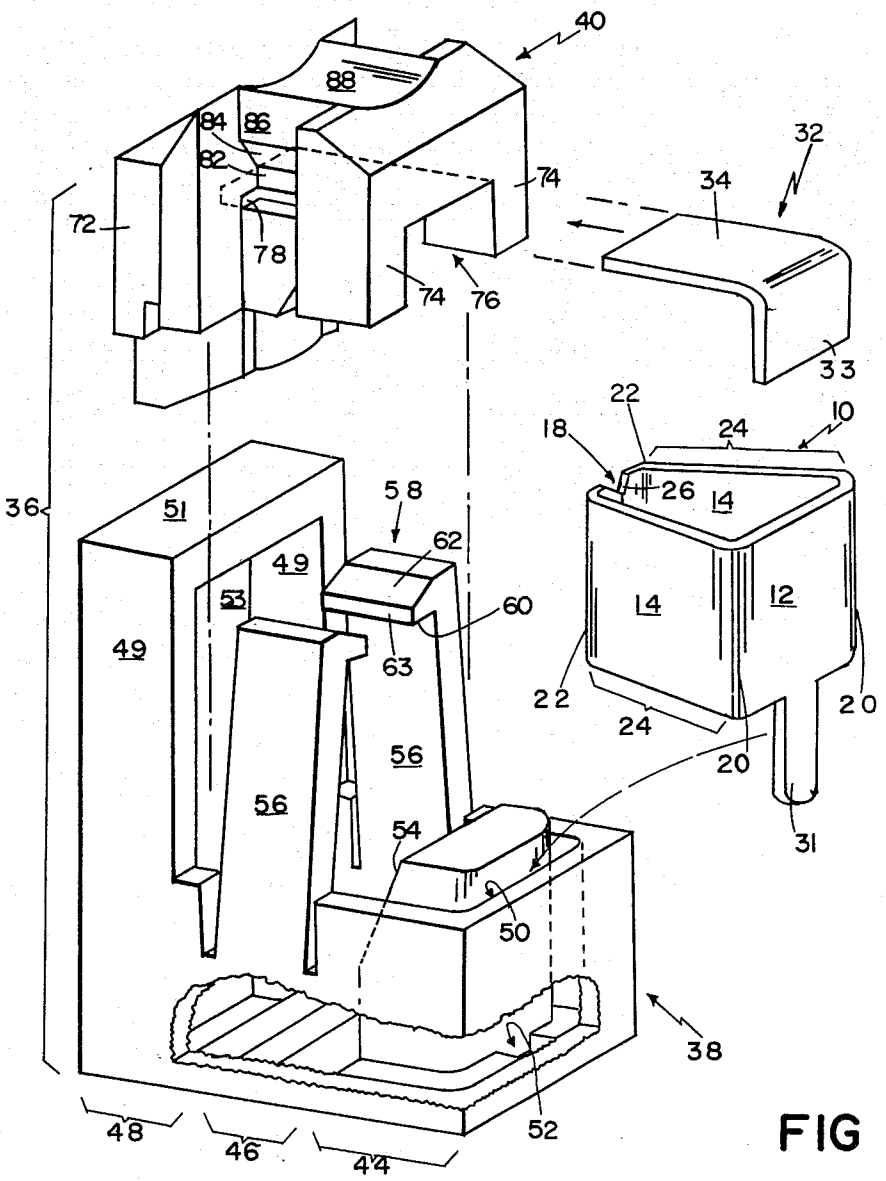
FIG. 2 is an exploded view of the elements of FIG. 1.

In the drawing, two embodiments of the terminal block according to the invention are shown. However, the terminal and clinch spring of the invention are the same in both embodiments. The terminal and clinch spring will first be described without reference to the terminal block; the two terminal block embodiments will then be described.

Figure 3:
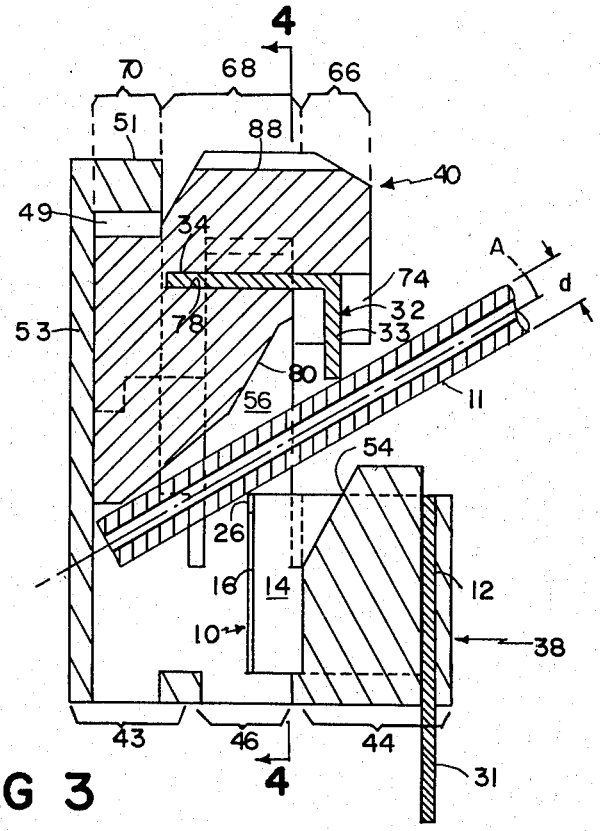
FIG. 3 is a sectional view of the terminal block in its wire-receiving position, taken on line 3—3 of FIG. 1, and shown with a wire in the block.

Referring first to FIG. 2, FIG. 7, and the detail view of FIG. 13, the terminal 10 (insulation displacing contact spring) of the invention is adapted to slice the insulation of a wire comprising a layer of insulation surrounding a metal conductor (for example, wire 11 in FIG. 3). The wire 11 has a predetermined diameter d and a central axis A. Terminal 10 is made of resilient, electrically conductive sheet metal of at least five times greater width than thickness. Terminal 10 has a generally flat trunk 12 and a pair of opposing spring arms 14 integrally connected to trunk 12 at opposite sides thereof. Spring arms 14 are relatively long compared with trunk 12 and have opposed, widthwise-extending, insulation-slicing, generally parallel, wire-contacting edges 16 (FIG. 12). Edges 16 are remote from trunk 12 and lie generally in a single plane. Edges 16 are narrowly spaced from one another to define a wire-receiving slit 18 therebetween. Slit 18 is narrower than the diameter of any wire for which the terminal is designed.

The portion of spring arm 14 extending between trunk 12 and edge 16 has a rounded trunk corner 20 adjacent trunk 12, and a rounded edge corner 22 adjacent edge 16. Corners 20 and 22 have a longitudinally-extending, generally straight connecting portion 24 between them. Connection portion 24 forms with trunk 12 an included angle of less than about 90 degrees at trunk corner 20; portion 24 forms with the plane of opposed edges 16 an included angle of greater than about 90 degrees at edge corner 22.

Each edge 16 provides a beveled corner 26 at one end for receiving, engaging and slicing the surrounding insulation of the wire. The portion of spring arm 14 between edge corner 22 and edge 16 is coined adjacent 16 to provide a portion of reduced thickness, as shown at 28 (FIG. 13), compared with the thickness (indicated at 30, FIG. 13) of the remainder of terminal 10. Terminal 10 further provides an electrical contact or tail 31 extending from trunk 12.

Strain relief clinch spring 32 (FIG. 2) is made of resilient sheet metal of at least five times greater width than thickness. Clinch spring 32 comprises a generally rectangular blank which is bent at substantially a right angle to provide a wire-engaging tongue 33 and a retaining tab 34.

Figure 1:
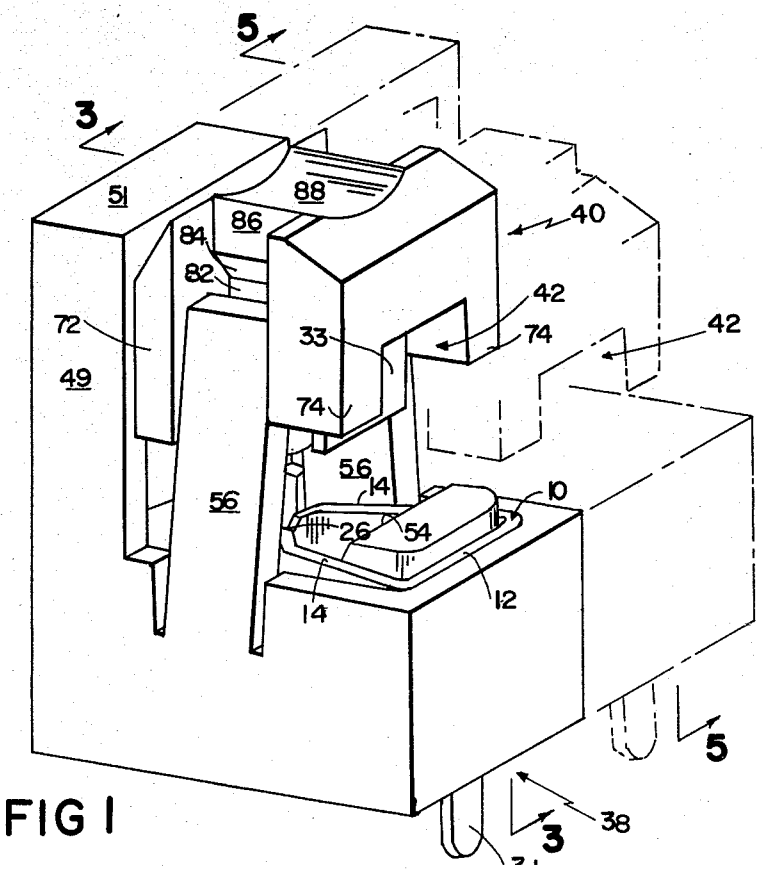
FIG. 1 is a perspective view of the terminal block according to a first embodiment of the invention, including the terminal and clinch spring, showing the terminal block in its wire-receiving position in solid line and in its wire-retaining position in phantom.

Turning now to the terminal block in which clinch spring 32 and terminal 10 are provided, and still referring to FIG. 2, in a first embodiment, the terminal block 36 of the invention comprises a base 38 and a top 40. Base 38 has a flat bottom surface adapted to be connected to a flat substrate such as a printed circuit board, defined as horizontal. Terminal 10 is positioned in base 38 (FIG. 1).

Base 38 and top 40 together provide cooperating locking means, to be described, adapted to lock base 38 and top 40 together in one of two terminal block positions, a first position in which base and top are spaced apart to admit a wire, and a second position in which base and top are closed to retain a wire. The first position is seen in FIG. 1, solid outline portion, and in FIGS. 3 and 4. The second position is seen in FIG. 1, in phantom, and in FIGS. 5 and 6. Top 40 is movable relative to base 38, by external force applied to the top, to move the terminal block 36 from its first to its second position. Base 38 and top 40 each provide structure, to be described, which together define, in either position, a wire aperture 42 at the front of terminal block 36. The wire aperture is adapted to permit a wire to leave block 36 generally horizontally (defined as parallel with the substrate to which base 38 is secured).

Clinch spring 32 is positioned in top 40 such that wire-engaging tongue 33 extends generally vertically downward with respect to base 38, and forward of terminal slit 18 in the second, wire-retaining position of the terminal block (as seen particularly in FIG. 3).

Base 38 provides wire-positioning structure, to be described in detail, adjacent terminal slit 18 and forward thereof (forward being defined as in the direction in which the wire leaves the terminal block); top 40 provides wire-positioning structure, to be described in detail, adjacent tongue 33 and rearward thereof. The base and top wire-positioning structure cooperate, during motion of top 40 from the first, spaced-apart position of base and top to their second, closed position, to force a wire between terminal edge beveled portions 26 and downwardly into slit 18. Edges 16 are generally normal to the wire and slice the insulation surrounding it to make electrical contact between the wire and terminal 10. At the same time, tongue 33 is forced through the insulation into a retaining relationship with the wire.

In more detail as to the first embodiment of the terminal block, referring now to FIGS. 1–6, terminal block base 38 comprises generally a forward section 44, a middle section 46, and a back section 48. Base forward and middle sections 44 and 46 together provide a recess 50 opening away from the base flat bottom surface. Base forward section 44 provides a passage 52 communicating between recess 50 and the base flat bottom surface. As is seen particularly in FIG. 3, base recess 50 and passage 52 are adapted to receive terminal 10 with its electrical contact or tail 31 extending through passage 52, terminal trunk 12 lying above contact 31. Wire receiving slit 18 of terminal 10 lies adjacent base back section 48.

Base back section 48 provides a guide structure comprising side elements 49 and a bridge element 51 (FIG. 2). Base back section 48 is closed by a back wall 53.

Terminal block base 38 further provides wire-positioning and supporting structure within recess 50 and surrounded by terminal (contact spring) 10. The wire-positioning structure has a wire-positioning surface 54 (best seen in FIG. 3) sloping upwardly from adjacent the bottom of terminal slit 18 to adjacent terminal trunk 12, and having a maximum height above recess 50 of greater than the height of terminal 10, as seen in FIG. 3.

Base middle section 46 provides a pair of opposed top-retaining arms 56 each extending upwardly with respect to terminal base flat bottom surface. Each top-retaining arm 56 provides a top-engaging structure 58 at its end remote from the base bottom surface. Each top-retaining arm 56 is resiliently connected to base middle section 46, and arms 56 are biased inwardly toward one another.

Each top-engaging structure 58 comprises a top-engaging surface 60 (best seen in FIG. 6) lying generally parallel with the base 38 flat bottom surface and disposed on the inward side of the top-retaining arm 56; a first camming surface 62 sloping upwardly and outwardly from adjacent the inner end of top-engaging surface 60; and a generally vertical tip surface 63 between surfaces 60 and 62.

Referring particularly to FIG. 3, top 40 comprises generally a forward section 66, a middle section 68, and a back section 70. Top back section 70 provides a slide element 72 (best seen in FIG. 2) which is engageable with the guide elements 49 of base back section 48 to define a direction of relative motion between top 40 and base 38 generally parallel with wire-receiving slit 18 of terminal 10.

Top front section 66 provides two legs 74 (seen in FIG. 2) which define between them an aperture 76, which is adapted to cooperate with the wire-positioning structure of base 38 and with base forward section 44 to define terminal block wire-admitting aperture 42 (FIG. 1). Top 40 further provides a recess 78, opening toward the front of top 40, which is adapted to receive clinch spring retaining tab 34 in such a way that, when clinch spring 32 is received in top 40, clinch spring wire-engaging tongue 33 extends downwardly toward the base wire-positioning structure wire-positioning surface 54.

Top 40 provides an interior wire-positioning surface 80 (best seen in FIG. 3) below recess 78 and rearward of clinch spring wire-engaging tongue 33, sloping generally parallel with base wire-positioning surface 54. Middle section 68 of top 40 further provides base-engaging structure adapted to engage with base arm top-engaging structures 58. The base-engaging structure (FIG. 2) comprises, on either side of top 40, a generally vertical inner surface 82, a camming surface 84 sloping upwardly and outwardly from inner surface 82, and a generally vertical outer surface 86; a bearing surface 88 connects outer surfaces 86. When clinch spring 32 is positioned in recess 78, the upper surface of retaining tab 34 is exposed below top middle section inner surfaces 82, as seen particularly in FIG. 4.

Figure 4:
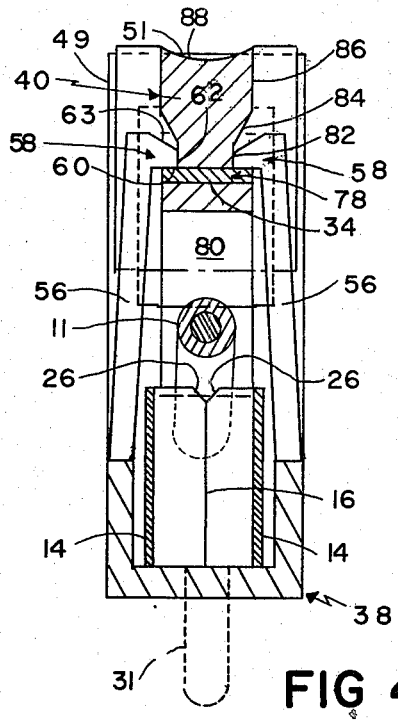
FIG. 4 is a sectional view taken on line 4—4 of FIG. 3.

As seen in FIG. 1 (solid line) and in FIGS. 3 and 4, top 40 and base 38 cooperate, in the first, wire-admitting relative position of the terminal block, to permit a wire to be placed overlying contact spring terminal wire-receiving slit 18 and base wire-positioning surface 54, and extending through the wire-admitting aperture 42. In this first relative position of top 40 and base 38, base arm top-engaging surfaces 60 overlie the exposed upper surface portions of the clinch spring retaining tab 34 and thereby retain top 40 from further travel away from from base 38.

Top 40 is movable relative to base 38 by the application of external force to the top bearing surface 88, to move the terminal block 10 from its first, wire-admitting relative position to its second, wire-retaining relative position. The motion is guided and its direction defined by the engagement of top slide elements 72 with base side elements 49.

Figure 5:
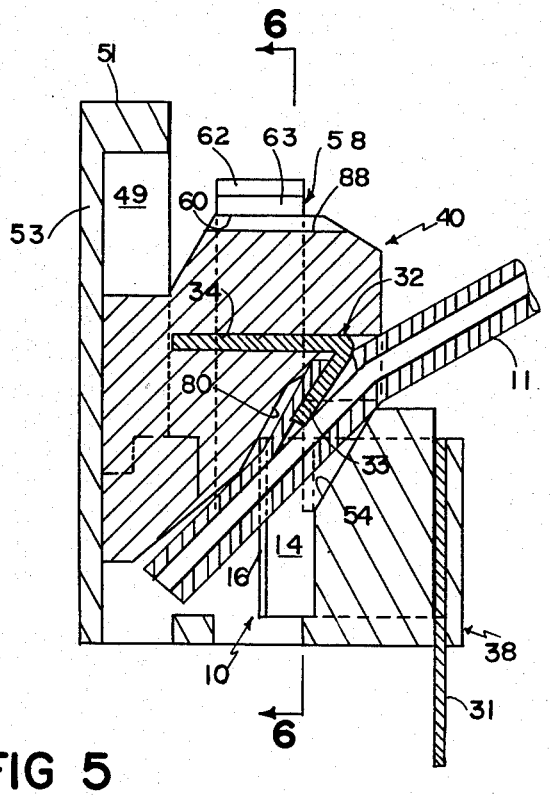
FIG. 5 is a sectional view taken on line 5—5 of FIG. 1, showing the terminal block in its wire-retaining position, with a wire in the block.
Figure 6:
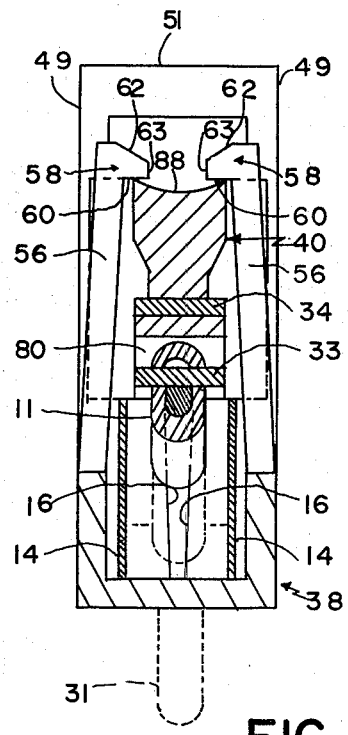
FIG. 6 is a sectional view taken on line 6—6 of FIG. 5.

During such motion, the base arm first camming surfaces 62, or the edges thereof, move on the top middle section second camming surfaces 84 to cam base arms 56 outwardly against their inward bias and thereby to disengage the base arm top-engaging surfaces 60 from the exposed upper surface portions of clinch spring retaining tab 34. Base arms 56 move outwardly until their vertical tip surfaces 63 engage vertical outer surfaces 86 of top 40. Top 40 is moved further downwardly toward base 38, until base arm top-engaging structures 58 clear the top base-engaging structure. At this point, the base top-retaining arms 56 are free to move inwardly (being biased inwardly) and their top-engaging surfaces 60 engage the outer margins of top bearing surface 88, as seen in FIGS. 5 and 6. Top 40 is thereafter retained by base arms 56 in the second, wire-retaining position of terminal block 10.

During the relative motion of base 38 and top 40, the base wire-positioning surface 54 cooperates with the top wire-positioning surface 80 to force wire 11 downwardly between beveled corners 26 of terminal edges 16, and thereafter into terminal wire-receiving slit 18, thereby to force wire contacting edges 16 through the insulating material of the wire and into engagement with the conductor, and to force the clinch spring wire-engaging tongue 33 into the insulation forwardly of the terminal wire-receiving slit 18.

Referring now to FIGS. 7 through 11, the second embodiment of the terminal block will be described.

Referring now particularly to FIG. 8, in a second embodiment, the terminal block 136 of the invention comprises a base 138 and a top 140. Base 138 has a flat bottom surface adapted to be connected to a flat substrate such as a printed circuit board, defined as horizontal. Terminal 10 is positioned in base 138. Terminal 10 is the same as previously described in detail.

Base 138 and top 140 together provide cooperating locking means, to be described, adapted to lock base 138 and top 140 together in either of two terminal block positions, a first position (shown in FIGS. 9, 11 and 12) in which base and top are spaced apart to admit a wire, and a second position (shown in FIG. 10) in which base and top are closed to retain a wire. Top 140 is movable by external force applied to it to move terminal block 136 from the first to the second position. Base 138 and top 140 each provide structure, to be described, which together define, in either position, a wire aperture 142 at the front of terminal block 136. The wire aperture is adapted to permit a wire to leave block 136 generally horizontally (defined as parallel with the substrate to which base 138 is secured).

Clinch spring 32 (which is the same as has previously been described in detail) is positioned in top 140 such that wire-engaging tongue 33 extends generally vertically downward with respect to base 138, and forward of terminal slit 18 (forward being defined as in the direction in which the wire leaves the terminal block), as seen particularly in FIG. 9.

Base 138 provides wire-positioning structure, to be described in detail, adjacent terminal slit 18 and forward thereof; top 140 provides wire-positioning structure, to be described in detail, adjacent tongue 33 and rearward thereof. The base and top wire-positioning structure cooperate, during motion of top 140 from the first, wire-admitting position of block 136 to its second, wire-retaining position, to force a wire between terminal beveled edge portions 26 and downwardly into slit 18. Edges 16 are generally normal to the wire and slice the insulation surrounding the conductor to make electrical contact between the conductor and terminal 10. At the same time, tongue 33 is forced through the insulating material into a retaining relationship with the wire.

More in detail, and referring especially to FIG. 9, in the second embodiment of the terminal block, base 138 comprises generally a forward section 144, a middle section 146, and a back section 148 (FIG. 9). Base middle section 146 provides a recess 150 (FIG. 7) opening away from the base flat bottom surface, and a passage 152 (FIG. 9) communicating between recess 150 and the base flat bottom surface. As is seen particularly in FIG. 9, base recess 150 and passage 152 are adapted to receive terminal 10 with its electrical contact or tail 31 extending through passage 152, terminal trunk 12 lying above contact 31. Wire-receiving slit 18 of terminal 10 lies adjacent base back section 148.

Base forward section 144 provides guide structure comprising two curved pivot bearing surfaces 154. Terminal block base 138 further provides wire-positioning structure within recess 150 and surrounded by terminal 10. The wire-positioning structure has a wire-positioning surface 156 (best seen in FIGS. 7 and 9) sloping upwardly from adjacent the bottom of terminal slit 18 to adjacent terminal trunk 12. Base back section 148 provides a pair of opposed top-retaining arms 158 each extending upwardly with respect to base flat bottom surface. Each top-retaining arm 158 provides a top-engaging structure at its end remote from the base bottom surface. Each top-engaging structure comprises a top-engaging surface 160 (best seen in FIG. 10) lying generally parallel with the base 138 flat bottom surface and disposed on the inward side of the top-retaining arm 158, a first camming surface 162 sloping upwardly and outwardly from adjacent the inner end of top-engaging surface 160, and a generally vertical tip surface 163 between surfaces 160 and 162.

Referring particularly to FIG. 9, top 140 comprises generally a forward section 166, a middle section 168, and a back section 170. Top forward section 166 provides two pivot ears 172 which are journaled in base pivot bearings 154 to define an arcuate direction of relative motion of top 140 with respect to base 138. The back section 148 of top 140 thus moves in a direction generally parallel with wire-receiving slit 18 of terminal 10.

Top back section 170 provides two legs 174, each resiliently connected to top back section 170 and biased outwardly. Each leg 174 provides a base-engaging structure comprising a second camming surface 184 sloping upwardly and outwardly from the bottom of the leg, a generally vertical outer surface 186 adjacent and above surface 184, a base-engaging surface 188 generally parallel with the flat bottom surface of base 138 in the second, wire-retaining position of the terminal block, and a generally vertical inner surface 190.

Top middle section 168 further provides a recess opening toward the front of top 140, which is adapted to receive clinch spring retaining tab 34 in such a way that, when clinch spring 32 is received in top 140, clinch spring wire-engaging tongue 33 extends downwardly toward the base wire-positioning surface 156.

Top 140 provides an interior wire-positioning structure 176 below and rearward of clinch spring wire-engaging tongue 33, extending generally toward the bottom of base 138.

Top 140 is movable relative to base 138 by the application of external force to the top surface 169 of middle section 168, to cause top 140 to pivot about pivot ears 172 journaled in bearing surfaces 154. Such pivotal motion moves the terminal block from its first, wire-admitting relative position to its second, wire-retaining relative position.

During such motion, the top leg second camming surfaces 184 (or the edges thereof) move on the base arm first camming surface 162, causing the top legs 174 to be compressed inwardly toward one another against their outward bias. As the pivotal motion of top 140 continues, top vertical surfaces 186 move past base arm tip surfaces 163, after which top legs 174 are freed to move outwardly to bring their base-engaging surfaces 188 into engagement with base arm top-engaging surfaces 160, as seen in FIG. 12. The outward bias of the arms 174 aids in retaining top 140 and base 138 in the second, closed position of the terminal block.

During the relative motion of base 138 and top 140, the base wire-positioning surface 156 cooperates with the top wire-positioning structure 176 to force wire 11 downwardly between beveled corners 26 of terminal edges 16, and thereafter into terminal wire-receiving slit 18, thereby to force wire contacting edges 16 through the insulating material of the wire and into engagement with the wire, and to force the clinch spring wire-engaging tongue 33 through the insulation forwardly of the terminal wire receiving slit 18.

In the second preferred embodiment, the travel of the flexible top legs 174 is less than the travel of the base arms 56 of the first preferred embodiment, which reduces the risk of breakage of the flexing parts in the second as compared with the first embodiment. In addition, in the second embodiment, the pull force on the wire is shared between the cooperative locking means and the pivot ears.

The two terminal blocks and terminal of the invention will accept a wire in the range of 14 to 20 gauge. The terminal spring arms remain compliant over this range of wire sizes.

What is claimed is:

1. A one-piece, insulation-displacing contact spring terminal adapted to slice the surrounding insulation of a wire comprising an insulation-clad conductor, said conductor having a predetermined diameter and having a central axis, by relative movement of said wire in a direction generally perpendicular to its axis to establish positively-gripping electrical contact with said conductor, said contact spring terminal being of resilient, electrically conductive sheet metal of at least five times greater width than thickness and having a generally flat trunk and a pair of opposing spring arms integrally connected to said trunk at opposite sides thereof, each said spring arm being longer than the length of said trunk, said spring arms having opposed, widthwise-extending, insulation-slicing, generally parallel, wire-contacting edges of reduced thickness remote from said trunk and lying generally in a single plane and spaced from one another to define a wire-receiving slit (18) therebetween narrower than the diameter of said conductor, the portion of a said spring arm extending between said trunk and said edges having a rounded trunk corner adjacent said trunk and a rounded edge corner adjacent said edge with an longitudinally-extended, generally straight connecting portion therebetween, said connecting portion being bent at an included angle with said trunk of less than about ninety degrees and an included angle with the plane of said opposed edges of greater than about ninety degrees, said wire-contacting edges having at at least one end thereof opposed beveled corners for receiving, engaging and slicing the surrounding insulation of said wire by movement of said wire relative to said terminal between said corners and into said slit between said opposed edges in a direction generally perpendicular to the axis of said wire and of said plane and through said slit to establish positively-gripping electrical contact between said contact spring terminal and said wire conductor.

2. A terminal block for connecting a wire comprising a conductor surrounded by insulating material to electrical circuitry, said block comprising a base and a top, said base having a flat bottom adapted to overlie a flat substrate, defined as horizontal, said base and top providing cooperating locking means adapted to lock said base and top together in one of a first, wire-admitting terminal block position and a second, wire-retaining terminal block position, said base and said top being relatively movable by external force applied to said top from said first to said second terminal block position, said base providing a conductive contact spring terminal having opposed wire-contacting edges defining a wire-receiving slit at the rear of said terminal, said terminal providing an electrical contact extending through said base flat bottom, said base and top providing structure together defining in either position a wire aperture at the front of said terminal block, said wire aperture being adapted to admit a said wire generally horizontally, said top providing a clinch spring having a downwardly extending wire-engaging tongue forward of said terminal wire-receiving slit in said second, wire-retaining terminal block position, said base having wire-positioning structure adjacent said terminal slit and forward thereof, said top having wire-positioning structure adjacent said tongue and rearward thereof, said base and top wire-positioning structure cooperating, during relative motion of said top and base from said first, wire-admitting terminal block position to said second, wire-retaining position, to force a said wire downwardly into said slit, said edges being generally normal to said wire and extending through said insulating material into electrical contact with said conductor, and to force said tongue into said insulating material into retaining relationship with said wire, said base contact spring terminal and said top clinch spring cooperating, in said second wire-retaining position of said terminal block, to retain said wire against pulling and twisting of the free end thereof.

3. The terminal block of claim 2 wherein said contact spring terminal is of resilient, electrically conductive sheet metal of at least five times greater width than thickness, and providing a generally flat trunk and a pair of opposing spring arms integrally connected to said trunk at opposite sides thereof, and resiliently and compliantly movable with respect thereto, said spring arms together providing a pair of opposed parallel widthwise extending wire-contacting edges lying generally in a single plane and spaced from one another to define said wire-receiving slit therebetween remote from said trunk, said electrical contact extending from said terminal trunk generally parallel with said wire-receiving slit.

4. The terminal block of claim 2 wherein said clinch spring is of a resilient sheet metal, and comprises a retaining tab and a said wire-engaging tongue incuding an angle of about ninety degrees between them, said wire-engaging tongue being forward of said contact spring terminal wire-receiving slit in said second, wire-retaining position of said terminal block.

5. The terminal block of claim 2 wherein said base comprises generally a forward section, a middle section and a back section, said base forward and middle sections being adapted to receive said terminal with said terminal wire-receiving slit lying adjacent said base back section, said base middle section providing a pair of opposed top-retaining arms each extending upwardly with respect to said base flat lower surface, each said top-retaining arm being resiliently connected to said base middle section, said top-retaining arms being biased inwardly toward one another, each said top-retaining arm having a top-engaging structure at its end remote from said base flat lower surface, a said top-engaging structure comprising a top-engaging surface lying generally parallel with said base lower surface and disposed on the inward side of said top-retaining arm, a first camming surface sloping upwardly and outwardly from adjacent the inner edge of said top-engaging surface, and a generally vertical tip surface between said top-engaging surface and said first camming surface, said top comprising generally a forward section, a middle section, and a back section, said top back section providing a slide element engageable with said base back section to define a direction of said relative motion between said top and said base generally parallel with said terminal wire-receiving slit, said top middle section providing base-engaging structure adapted to engage with said base arm top-engaging structures, said base-engaging structure comprising on either side of said top, a generally vertical inner surface, a second camming surface sloping upwardly and outwardly from said inner surface, and a generally vertical outer surface, and a bearing surface connecting said outer surfaces, said base top-retaining arms and said top base-engaging structure together comprising said cooperating locking means, said top being movable relative to said base by the application of external force to said top bearing surface to move said terminal block from its said first, wire-admitting position to its said second, wire-retaining position, said base arm first camming surfaces moving on said top middle section second camming surfaces to cam said base arms outwardly against their said inward bias and thereby to disengage said base arm top-engaging structures from said top lower base-engaging surfaces, said top-engaging arms thereafter moving inwardly to bring said base arm top-engaging structures into engagement with said top upper base-engaging surfaces to retain said terminal block in its said second position.

6. The terminal block of claim 2 wherein said base comprises generally a forward section, a middle section and a back section, said base forward and middle sections together providing a base recess opening away from said base flat lower surface, said base forward section providing a passage communicating between said base recess and said base flat lower surface, said base recess and passage being adapted to receive said terminal with said terminal electrical contact extending through said base passage, said terminal wire-receiving slit lying adjacent said base back section, said base further providing said base wire-positioning structure within said base recess and surrounded by said terminal, having a wire-positioning surface sloping upwardly and away from adjacent the bottom of said terminal wire-receiving slit and having a maximum height above said base recess of greater than that of said terminal, said top providing a top recess adapted to receive said clinch spring in such a way that said clinch spring wire-engaging tongue extends downwardly toward said base wire-positioning surface, said top comprising generally a forward section, a middle section, and a back section, said top back section providing a slide element engageable with said base back section to define a direction of said relative motion between said top and said base generally parallel with said terminal wire-receiving slit, said top middle section providing said top wire-positioning structure comprising a wire-positioning surface below said top recess and rearward of said clinch spring wire-engaging tongue, sloping generally parallel with said base wire-positioning surface, said base and top wire-positioning surfaces cooperating during said motion of said terminal block from its said first to its said second position to force said wire into said terminal wire-receiving slit from above, to force said wire-contacting edges through said insulating material and into engagement with said conductor, and to force said clinch spring wire-engaging tongue into said insulating material forwardly of said terminal wire-receiving slit.

7. The terminal block of claim 2 wherein said base comprises generally a forward section, a middle section, and a back section, said base middle section being adapted to receive said terminal with said terminal wire-receiving slit lying adjacent said base back section, said base back section providing a pair of opposed top-retaining arms each extending upwardly with respect to said base flat bottom surface, each said top-retaining arm providing a top-engaging structure at its end remote from said base bottom surface, each said top-engaging structure comprising a top-engaging surface lying generally parallel with said base flat bottom surface and disposed on the inward side of said top-retaining arm, a first camming surface sloping upwardly and outwardly from adjacent the inner end of said top-engaging surface, and a generally vertical tip surface between said top-engaging surface and said first camming surface, said top comprising generally a forward section, a middle section, and a back section, said top back section providing two legs, each said leg being resiliently connected to said top back section and biased outwardly of said top, each said leg providing a base-engaging structure comprising a second camming surface sloping upwardly and outwardly from the bottom of said leg, a generally vertical outer surface adjacent and above said second camming surface, a base-engaging surface generally parallel with said base flat bottom surface in said second, wire-retaining terminal block position, and a generally vertical inner surface, said base top-retaining arms and said top legs comprising said cooperative locking means, said base forward section providing two curved pivot bearing surfaces, and said top forward section providing two pivot ears each journaled in a said base pivot bearing surface to define an arcuate direction of relative motion of said top with respect to said base, said top back section moving in a direction generally parallel with said wire-receiving slit during said relative motion, said top legs being disengaged from said base arms in said terminal block first, wire-admitting position, said top being movable with respect to said base by the application of external force to the top surface of said top middle section to cause said top to pivot about said pivot ears journaled in said bearing surfaces, to move said terminal block from its said first, wire-admitting position to its second, wire-retaining position, said top leg second camming surfaces moving on said base arm first camming surfaces to cause said top legs to be compressed inwardly toward one another against their said outward bias, said top legs being thereafter freed to move outwardly to bring their said base-engaging surfaces into engagement with said base arm top-engaging surfaces to retain said terminal block in its said second, wire-retaining position.

8. The terminal block of claim 2 wherein said base comprises generally a forward section, a middle section and a back section, said base middle section providing a recess opening away from said base flat lower surface, and a passage communicating between said recess and said base flat bottom surface, said base recess and passage being adapted to receive said terminal with said terminal electrical contact extending through said base passage, said terminal wire-receiving slit lying adjacent said base back section, said base further providing wire-positioning structure within said recess and surrounded by said terminal, said wire-positioning structure having a wire-positioning surface sloping upwardly and away from adjacent the bottom of said terminal wire-receiving slit, said base forward section providing two curved pivot bearing surfaces, said top comprising generally a forward section, a middle section, and a back section, said top forward section providing two pivot ears journaled in said base pivot bearing surfaces to define an arcuate direction of relative motion of said top with respect to said base, said top back section moving in a direction generally parallel with said wire-receiving slit during said relative motion, said top middle section providing a top recess adapted to receive said clinch spring in such a way that said clinch spring wire-engaging tongue extends downwardly toward said base wire-positioning surface, said top further providing interior wire-positioning structure below and rearward of said clinch spring wire-engaging tongue, extending generally toward the bottom of said base, said base and top wire-positioning structure cooperating during said motion of said terminal block from its said first to its said second position to force said wire into said terminal wire-receiving slit from above, to force said wire-contacting edges through said insulating material and into engagement with said conductor, and to force said clinch spring wire-engaging tongue into said insulating material forwardly of said terminal wire-receiving slit.

9. A terminal connector block for connecting a wire comprising a conductor surrounded by insulating material to electrical circuitry, comprising a base and a top adapted to engage with one another in either of a first, wire-admitting terminal block position and a second, wire-retaining terminal block position, and relatively movable from said first to said second position, a contact spring terminal carried in said base, and a clinch spring carried in said top, said contact spring terminal being of resilient, electrically conductive sheet metal of at least five times greater width than thickness, and providing a generally flat trunk and a pair of opposing spring arms integrally connected to said trunk at opposite sides thereof, and resiliently and compliantly movable with respect thereto, said spring arms together providing a pair of opposed parallel widthwise extending wire-contacting edges lying generally in a single plane and spaced from one another to define a wire-receiving slit therebetween remote from said trunk, said terminal further including an electrical contact extending from said trunk generally parallel with said wire-receiving slit, said clinch spring being of a resilient sheet metal, and comprising a retaining tab and a wire-engaging tongue including an angle of about 90 degrees between them, said base providing a generally flat lower surface adapted to overlie a generally flat substrate, said base comprising generally a forward section, a middle section, and a back section, said base forward and middle sections together providing a recess opening away from said base lower surface, said base forward section providing a passage communicating between said base recess and said base lower surface, said base recess and passage being adapted to receive said terminal with said electrical contact extending through said base passage and with said terminal trunk lying above said electrical contact, said terminal wire-receiving slit lying adjacent said base back section, said base further providing wire-positioning structure within said base recess and surrounded by said terminal, having a wire-positioning surface sloping upwardly from adjacent said terminal wire-receiving slit to adjacent said trunk and having a maximum height above said base recess of greater than that of said terminal, said base middle section providing a pair of opposed top-retaining arms each extending upwardly with respect to said base lower surface, each said top-retaining arm providing top-engaging structure at its end remote from said base flat lower surface, each said top-retaining arm being resiliently connected to said base middle section, said top-retaining arms being biased inwardly toward one another, said top-engaging structure comprising a top-engaging surface lying generally parallel with said base lower surface and disposed on the inward side of said top-retaining arm, a first camming surface sloping upwardly and outwardly from adjacent the inner edge of said top-engaging surface, and a generally vertical tip surface between said top-engaging surface and said first camming surface, said top providing a top recess adapted to receive said clinch spring retaining tab in such a way that said clinch spring wire-engaging tongue extends downwardly toward said base wire-positioning surface, said top comprising generally a forward section, a middle section, and a back section, said top back section providing a slide element engageable with said base back section to define a direction of relative motion between said top and said base generally parallel with said terminal wire-receiving slit, said top front section providing an aperture adapted to cooperate with said base wire-positioning structure and said base forward section in either of said first and said second positions to define a terminal block wire-admitting aperture, said top middle section providing a wire-positioning surface below said top recess and rearward of said clinch spring wire-engaging rongue, sloping generally parallel with said base wire-positioning surface, said top middle section further providing base-engaging structure adapted to engage with said base arm top-engaging structures, said base-engaging structure comprising on either side of said top, a generally vertical inner surface, a camming surface sloping upwardly and outwardly from said inner surface, and a generally vertical outer surface and a bearing surface connecting said outer surfaces, said base top-retaining arms and said top base-engaging structure together defining cooperating locking means locking said base and said top together in either of said first, wire-admitting position and said second, wire-retaining position, said top and said base in said first, wire-admitting terminal block position cooperating to permit a said wire to be placed overlying said terminal wire-receiving slit and said base wire positioning surface and extending through said wire-admitting aperture, said top being movable relative to said base by the application of external force to said top bearing surface to move said terminal block from said first, wire-admitting terminal block position to said second, wire-retaining terminal block position, said base arm first camming surfaces moving on said top middle section second camming surfaces to cam said base arms outwardly against said bias and thereby to disengage said base arm top-engaging structures from said top lower base-engaging surfaces, said top-engaging arms thereafter moving inwardly to bring said base arm top-engaging structures into engagement with said top upper base-engaging surfaces to retain said terminal block in said second position, said base and top wire-positioning surfaces cooperating during said relative motion to force said wire into said terminal wire-receiving slit from above, to force said wire-contacting edges through said insulating material and into engagement with said wire, and to force said clinch spring wire-engaging tongue through said insulation forwardly of said terminal wire-receiving slit.

10. A terminal connector block for connecting a wire comprising a conductor surrounded by insulating material to electrical circuitry, comprising a base and a top adapted to engage with one another in either of a first, wire-admitting terminal block position and a second, wire-retaining terminal block position, and relatively movable from said first to said second position, a contact spring terminal carried in said base, and a clinch spring carried in said top, said contact spring terminal being of resilient, electrically conductive sheet metal of at least five times greater width than thickness, and providing a generally flat trunk and a pair of opposing spring arms integrally connected to said trunk at opposite sides thereof, and resiliently and compliantly movable with respect thereto, said terminal spring arms together providing a pair of opposed parallel widthwise extending wire-contacting edges lying generally in a single plane and spaced from one another to define a wire-receiving slit therebetween remote from said trunk, said terminal further including an electrical contact extending from said terminal trunk generally parallel with said wire-receiving slit, said clinch spring being of a resilient sheet metal, and comprising a retaining tab and a wire-engaging tongue including an angle of about 90 degrees between them, said base providing a generally flat bottom surface adapted to overlie a generally flat substrate, said base comprising generally a forward section, a middle section, and a back section, said base middle section providing a recess opening away from said base bottom surface, and a passage communicating between said recess and said base bottom surface, said base recess and passage being adapted to receive said terminal with said terminal electrical contact extending through said base passage, said terminal wire-receiving slit lying adjacent said base back section, said base further providing wire-positioning structure within said recess and surrounded by said terminal, said wire-positioning structure having a wire-positioning surface sloping upwardly and away from adjacent the bottom of said terminal wire-receiving slit, said base forward section providing two curved pivot bearing surfaces, said base back section providing a pair of opposed top-retaining arms each extending upwardly with respect to said base bottom surface, each said top-retaining arm providing a top-engaging structure at its end remote from said base bottom surface, each said top-engaging structure comprising a top-engaging surface lying generally parallel with said base bottom surface and disposed on the inward side of said top-retaining arm, a first camming surface sloping upwardly and outwardly from adjacent the inner end of said top-engaging surface, and a generally vertical tip surface between said top-engaging surface and said first camming surface, said top comprising generally a forward section, a middle section, and a back section, said top forward section providing two pivot ears each journaled in a said base pivot bearing surface to define an arcuate direction of relative motion of said top with respect to said base, said top back section moving in a direction generally parallel with said wire-receiving slit during said relative motion, said top middle section providing a top recess adapted to receive said clinch spring in such a way that said clinch spring wire-engaging tongue extends downwardly toward said base wire-positioning surface, said top further providing interior wire-positioning structure below and rearward of said clinch spring wire-engaging tongue, extending generally toward the bottom of said base, said top back section providing two legs, each said leg being resiliently connected to said top back section and biased outwardly of said top, each said leg providing a base-engaging structure comprising a second camming surface sloping upwardly and outwardly from the bottom of said leg, a generally vertical outer surface adjacent and above said second camming surface, a base-engaging surface generally parallel with said base bottom surface in said second, wire-retaining terminal block position, and a generally vertical inner surface, said base top-retaining arms and said top legs defining cooperative locking means locking said base and said top together in either of said first, wire-admitting terminal block position and said second, wire-retaining terminal block position, said top and said base in said first, wire-admitting terminal block position cooperating to permit a said wire to be placed overlying said terminal wire-receiving slit and said base wire-positioning surface and extending between said top forward section and said base forward section, said top legs being disengaged from said base arms in said terminal block first, wire-admitting position, said top being movable with respect to said base by the application of external force to the top surface of said top middle section to cause said top to pivot about said pivot ears journaled in said bearing surfaces, to move said terminal block from its said first, wire-admitting position to its said second, wire-retaining position, said top leg second camming surfaces moving on said base arm first camming surfaces to cause said top legs to be compressed inwardly toward one another against their said outward bias, said top legs being thereafter freed to move outwardly to bring their said base-engaging surfaces into engagement with said base arm top-engaging surfaces to retain said terminal block in its said second, wire-retaining position, said base and top wire-positioning structure cooperating during said motion of said terminal block from its said first to its said second position to force a wire into said terminal wire-receiving slit from above, to force said wire-contacting edges through the wire insulating material and into engagement with the conductor, and to force said clinch spring wire-engaging tongue into the insulating material forwardly of said terminal wire-engaging slit.

* * * * *